US006502641B1

(12) United States Patent
Carriere et al.

(10) Patent No.: US 6,502,641 B1
(45) Date of Patent: Jan. 7, 2003

(54) COILED TUBING DRILLING RIG

(75) Inventors: Gene J. Carriere, Redcliff (CA); Thomas C. Gipson, Cisco, TX (US)

(73) Assignee: Precision Drilling Corporation, Calgary (CA)

( * ) Notice: Subject to any disclaimer, the term of this patent is extended or adjusted under 35 U.S.C. 154(b) by 0 days.

(21) Appl. No.: 09/574,972

(22) Filed: May 19, 2000

(30) Foreign Application Priority Data

Dec. 6, 1999 (CA) ..... 2292214

(51) Int. Cl.[7] ..... E21B 19/22
(52) U.S. Cl. ..... 166/384; 166/71.3
(58) Field of Search ..... 166/384, 385, 166/77.1, 77.2, 77.3; 175/173

(56) References Cited

U.S. PATENT DOCUMENTS

| | | | | |
|---|---|---|---|---|
| 3,690,136 | A | 9/1972 | Slator et al. | 72/160 |
| 4,361,192 | A | 11/1982 | Trowsdale | 340/853.5 |
| 4,379,493 | A | 4/1983 | Thibodeaux | 175/61 |
| 4,399,877 | A | 8/1983 | Jackson et al. | 175/45 |
| 4,463,814 | A | 8/1984 | Horstmeyer et al. | 175/45 |
| 4,673,035 | A | 6/1987 | Gipson | 166/77 |
| 4,789,032 | A | 12/1988 | Rehm et al. | 175/45 |
| 4,828,053 | A | 5/1989 | Maurer et al. | 175/75 |
| 4,854,397 | A | 8/1989 | Warren et al. | 175/26 |
| 4,858,705 | A | 8/1989 | Thiery | 175/73 |
| 4,884,643 | A | 12/1989 | Wawrzynowski et al. | 175/74 |
| 5,215,151 | A | 6/1993 | Smith et al. | 175/45 |
| 5,244,046 | A | 9/1993 | Council et al. | 166/380 |
| 5,291,956 | A | 3/1994 | Mueller et al. | 175/67 |
| 5,311,952 | A | 5/1994 | Eddison et al. | 175/61 |
| 5,388,639 | A | 2/1995 | Betchan et al. | 166/78 |
| 5,823,267 | A | 10/1998 | Burge et al. | 166/385 |
| 5,831,549 | A | 11/1998 | Gearhart | 340/853.1 |
| 5,839,514 | A | 11/1998 | Gipson | 166/384 |
| 5,842,530 | A * | 12/1998 | Smith et al. | 175/162 |
| 5,845,708 | A | 12/1998 | Burge et al. | 166/77.3 |

* cited by examiner

*Primary Examiner*—William Neuder
(74) *Attorney, Agent, or Firm*—Sheridan Ross P.C.

(57) ABSTRACT

A novel rotary table is secured to the top of a well's BOP simplifying the making up of sectional tubing joints used in some aspects of operations with coiled tubing. The rotary table comprises top a bottom stationary housing affixed to the BOP, a top housing supported on the bottom housing by an annular bearing, a split clamp to transferring the weight of the tubing to the top housing and seals between the top and bottom housings and between the top housing and the tubing. More preferably, a coiled tubing rig is provided having a frame, a tiltable mast, an injector reel, a tubing straightener and a jib crane in combination with the rotary table for increased functionality including drilling surface hole using coiled tubing. The mast tilts between two positions, either aligning coiled tubing and injector with the BOP or aligning a jib crane and tubing elevators for manipulating sectional tubing including BHA onto and through the rotary table.

10 Claims, 7 Drawing Sheets

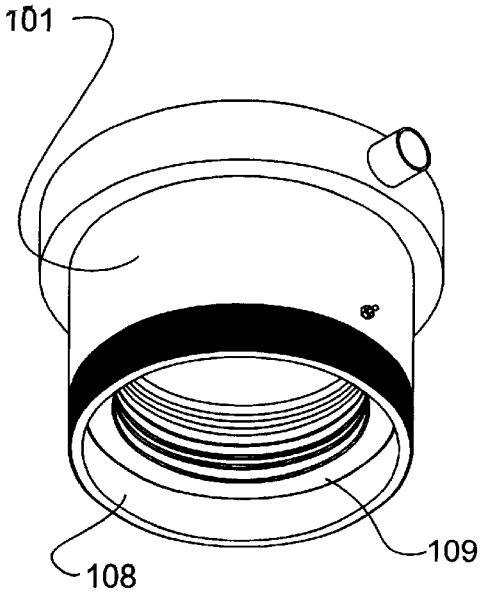
Fig. 6a
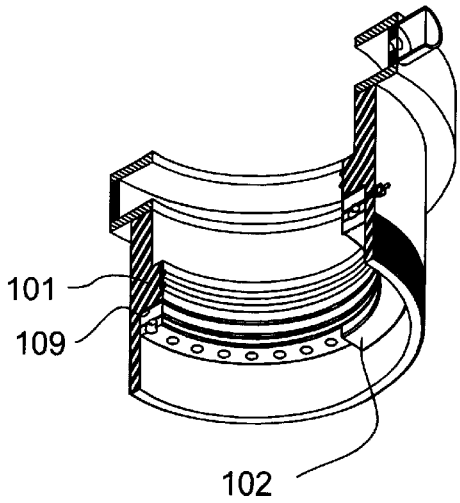
Fig. 6b
Fig. 6c
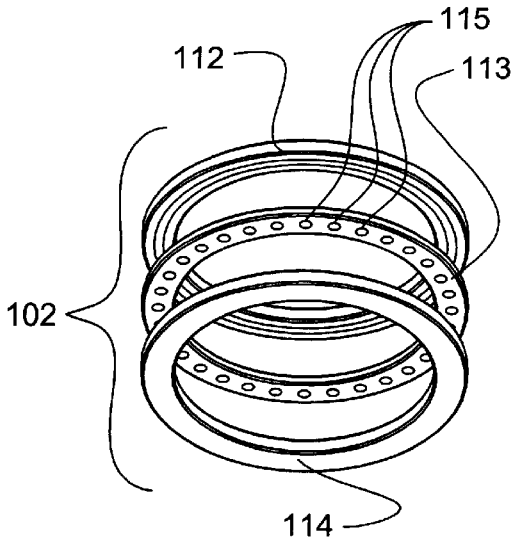
Fig. 6d
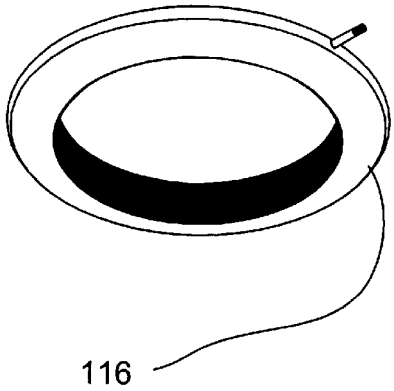

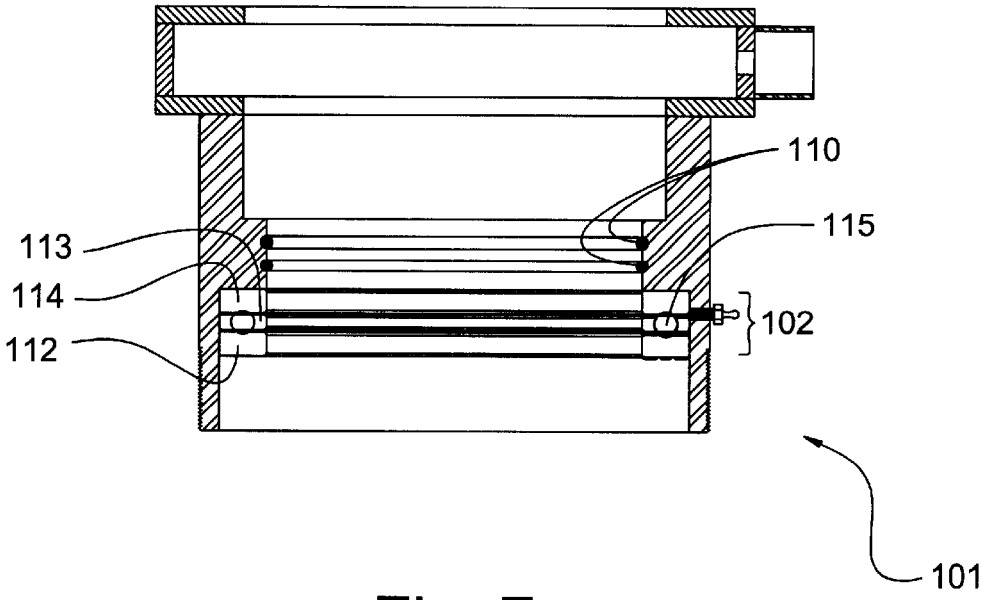
Fig. 7a
Fig. 7b
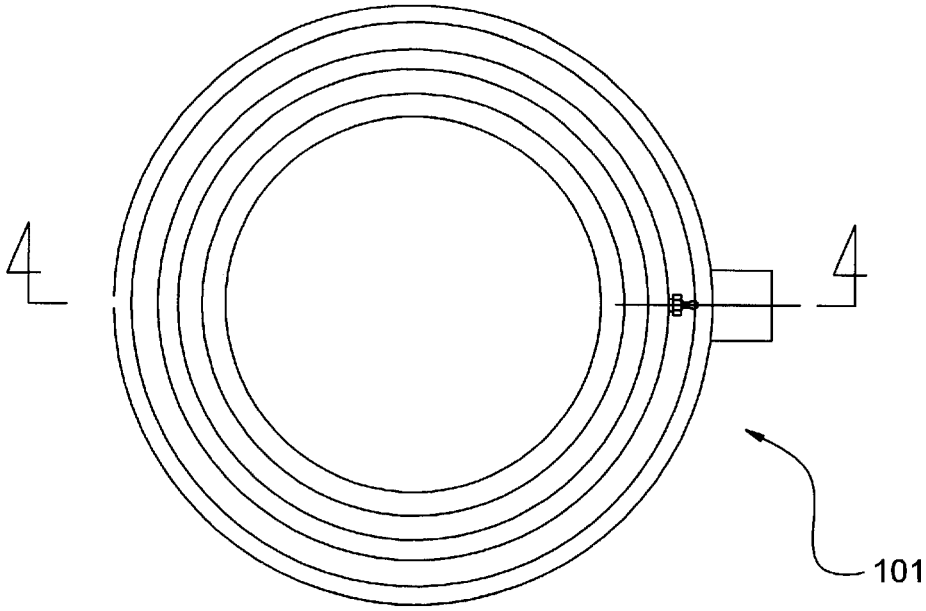

COILED TUBING DRILLING RIG

FIELD OF THE INVENTION

The present invention relates to apparatus and a process for drilling a well. More specifically, addition of a rotary table to the wellhead in combination with a coiled tubing rig and modifications thereto enable drilling a borehole in the earth including borehole adjacent the surface.

BACKGROUND OF THE INVENTION

The general background relating to coiled tubing injector units is described in U.S. Pat. Nos. 5,839,514 and 4,673,035 to Gipson which are incorporated herein by reference for all purposes.

Coiled tubing has been a useful apparatus in oil field operations due to the speed at which a tool can be injected and tripped out of a well bore (round trip). Coiled tubing is supplied on a spool. An injector at the wellhead is used to grip and control the tubing for injection and withdrawal at the well. Accordingly, it is known to connect a bottom hole assembly ("BHA") to the bottom of the coiled tubing and run it into the well bore using the injector. A BHA may include measuring and sampling tools, each being sectional and which are threaded together in series. A BHA may also include drill collars for weight. Further, use of downhole motors and coiled tubing became more popular when drilling deviated wells as it made more sense to limit drilling rotation to the bit and not the entire string which must flex through a turn.

As stated, coiled tubing has more recently become a contender in the drilling industry, due to the potential to significantly speed drilling and reduce drilling costs through the use of continuous tubing. The most significant cost saving factors include the reduced pipe handling time, pipe joint makeup time, and reduced leakage risks.

In spite of the significant potential cost savings through the use of coiled tubing, there are certain aspects of the associated apparatus and process which have limited its application to drilling.

Coiled tubing has been unable to cope with all stages of the drilling and have required the assistance of conventional rigs for handling jointed tubing for certain aspects of drilling a well. For example, coiled tubing has not been successfully used to drill surface hole due in part to a lack of bit weight at surface or shallow depths, lack of control over the coiled tubing's residual bend and the generally uneven strata at surface, such as glacial residue. Typically then, a separate and conventional rig is required to drill surface hole, place surface casing, cement and then drill the vertical well portion. Thereafter, coiled tubing is used to re-enter and deepen the hole a relatively short distance (i.e., coiled tube drilling only the last, smallest and shallow portion). Generally, coiled tubing is used to re-enter the vertical hole and drill a relatively short and deviated or horizontal lateral portion.

Further, after drilling, a separate rig is brought in to run in the sectional and tubular production casing.

Several restrictions are placed on the use of coiled tubing. One restriction is related to the inability to rotate coiled tubing. A conventional rotary drilling rig rotates the entire drill string from the surface for rotating a rotary drill bit downhole. The continuous coiled tubing is supplied from a spool at surface and cannot be rotated. Accordingly, a BHA including a downhole motor and drill bit is connected to the bottom end of the coiled tubing. Further, the BHA is typically threaded together and thereby results in a laborious threading of the multiple components separate from the coiled tubing. It is sometimes desirable to increase the weight on the bit early in the drilling and thus a few lengths of conventional drill collars might be to threaded onto the BHA.

The injector is typically located at the wellhead and must be set aside to permit the larger diameter BHA to be placed through the wellhead and into the hole. Further, when running in, the wellhead injector tends to inject tubing which has residual bend therein. A residual bend can result in added contact and unnecessary forces on the walls of the hole, resulting in increased frictional drag and an off-centered position of the tubing within the hole. Occasionally the coiled tubing wads up in the hole (like pushing a rope through a tube) and cannot be injected any further downhole or ever reach total depth.

Therefore, in practice, the above problems result in the need for multiple rigs; a conventional rig to drill and place surface casing, coiled tubing for the remainder of the drilling and a conventional rig again to place the production casing. Besides the duplicity for much of the equipment and personnel, such as pumping equipment, much time is lost in assembling the BHA.

For example, a conventional rig may take two days to spud in, drill surface casing, and cement the casing. The crew manually makes up a BHA, requiring in the order of 6 hours. A separate crane is generally employed to lower the BHA through the wellhead, the BHA being supported temporarily on slips. If weight is required, one or more drill collars are manually threaded into the BHA supported at the wellhead. Finally, a prior art coiled tubing rig is set up and connected to the BHA, injected down the surface casing and drilling may then begin. After drilling, the crane is again employed to withdraw the BHA from the well. Lastly a conventional rig is brought in again to place the jointed production casing.

Coiled tubing rigs, while faster, have a much higher capital cost and operating cost. The repeated plastic deformation of the coiled tube means it must be replaced often to avoid failure. Further, the rig incorporates spools, related equipment and pumps. The pumps and operating costs are greater due to the relatively small diameter of the coiled tubing, requires greater fluid horsepower to deliver mud to the downhole motor.

Thus, it is an objective to use the coiled tubing rig for a greater portion of the on-site operations, reduce the on-site time generally and improve the drilling process.

SUMMARY OF THE INVENTION

A novel combination of components has resulted in a novel coiled tubing rig capable of superior handling and drilling.

Through the addition of a novel rotary table to the well site, preferably secured to the top of the wellhead or BOP, sectional tubular components can be readily handled and the capabilities of a coiled tubing rig are markedly enhanced, now being able to easily make up BHA and yet retain the convenience and speed of a coiled tubing rig.

In a preferred embodiment of the invention, a coiled tubing rig is provided having a frame, a mast, an injector reel, a tubing straightener and a jib crane. In combination with the rotary table, the time required for spudding in and drilling 1100 meters of well is only about ½ to ⅓ of the time of a jointed tubing rig. Specifically, this is accomplished by tilting the mast between two positions, one with the coiled tubing injector aligned with the wellhead and a second with the injector out of alignment so as to permit the jib crane to align with the wellhead. The jib crane handles long lengths of BHA, threaded tubular components or other jointed sections between the wellhead and coiled tubing. The jib manipulates the BHA onto and through the rotary table. The rotary table supports the jointed BHA sections so that they are easily rotated while being supported so as to quickly make up threaded joints. Tilting the injector back over the wellhead, the BHA is attached to the coiled tubing so as to commence drilling. Preferably, the injector is mounted high above the wellhead so aid in the BHA handling. The straightener delivers straight coiled tubing which is directed through a supporting stabilizer. Even more preferably, adding power tongs to the jib crane and coupling that with the tilting capability of the mast enables jointed production casing to be quickly run in without need for another rig on site.

As a result of the above combination, the preferred coiled tubing rig is able to drill surface hole, place jointed surface casing, quickly make up jointed BHA, drill the well, withdraw the coiled tubing, quickly remove the BHA, and place jointed production casing.

Therefore, in a broad apparatus aspect of the invention, a rotary table is provided for the supported rotation of BHA or other sectional components at the wellhead comprising:

a bottom stationary housing affixed to the top of the wellhead;

a top rotational housing;

means such as slips or a split clamp for transferring the weight of the BHA to the top housing;

an annular bearing installed between the top and bottom housings; and seals between the top and bottom housings and between the top housing and the BHA.

Preferably the seal is an inflatable packer.

In another broad apparatus aspect of the invention, a coiled tubing rig, implemented in combination with the rotary table, creates a hybrid apparatus capable of superior site set-up, handling and functionality. More particularly, the apparatus comprises:

a coiled tubing rig having a frame and a mast normally aligned over a wellhead, an injector located in the mast and a tubing straightener positioned between the injector and the wellhead;

a rotary table affixed to the well head;

a jib crane mounted atop the mast; and means for pivoting the mast between two positions, a first position where the mast, injector and straightener are aligned with the wellhead for injection and withdrawing of coiled tubing, and a second position with the mast pivoted out of alignment from the wellhead so that the jib crane can align sectional tubing with the wellhead and be supported therefrom and be made up on the rotary table.

Preferably a stabilizer tube extends between the injector and the wellhead.

In another broad aspect of the invention, a method is provided comprising the steps of:

providing a rotary table over the well, preferably secured to a wellhead;

supporting tubular sections on the rotary table to enable rotation of adjacent sections for making up a drilling assembly including a downhole motor and drill bit;

aligning a coiled tubing injector over the drilling assembly;

rotating the drilling assembly to make up to the coiled tubing; and drilling the well through the rotary table.

BRIEF DESCRIPTION OF THE DRAWINGS

FIGS. 6*a*–6*d* are a variety of upward perspective views of components of the top housing. Specifically, FIG. 6*a* is a view of the top housing;

FIG. 6*b* is a sectional view of the top housing, according to FIG. 6*a*, illustrating, in dotted lines, installation of the ring bearing;

FIG. 6*c* is an exploded view of the three components of the ring bearing;

FIG. 6*d* is a view of an elastomeric seal for installation into the entrance of the top housing for sealing about a jointed section passing therethrough;

FIGS. 7*a* and 7*b* are views of the top housing. Specifically,

FIG. 7*a* is a side sectional view of the top housing with the ring bearing installed; and FIG. 7*b* is a top view of the top housing according to FIG. 7*a*.

DETAILED DESCRIPTION OF THE PREFERRED EMBODIMENT

Figure 1:
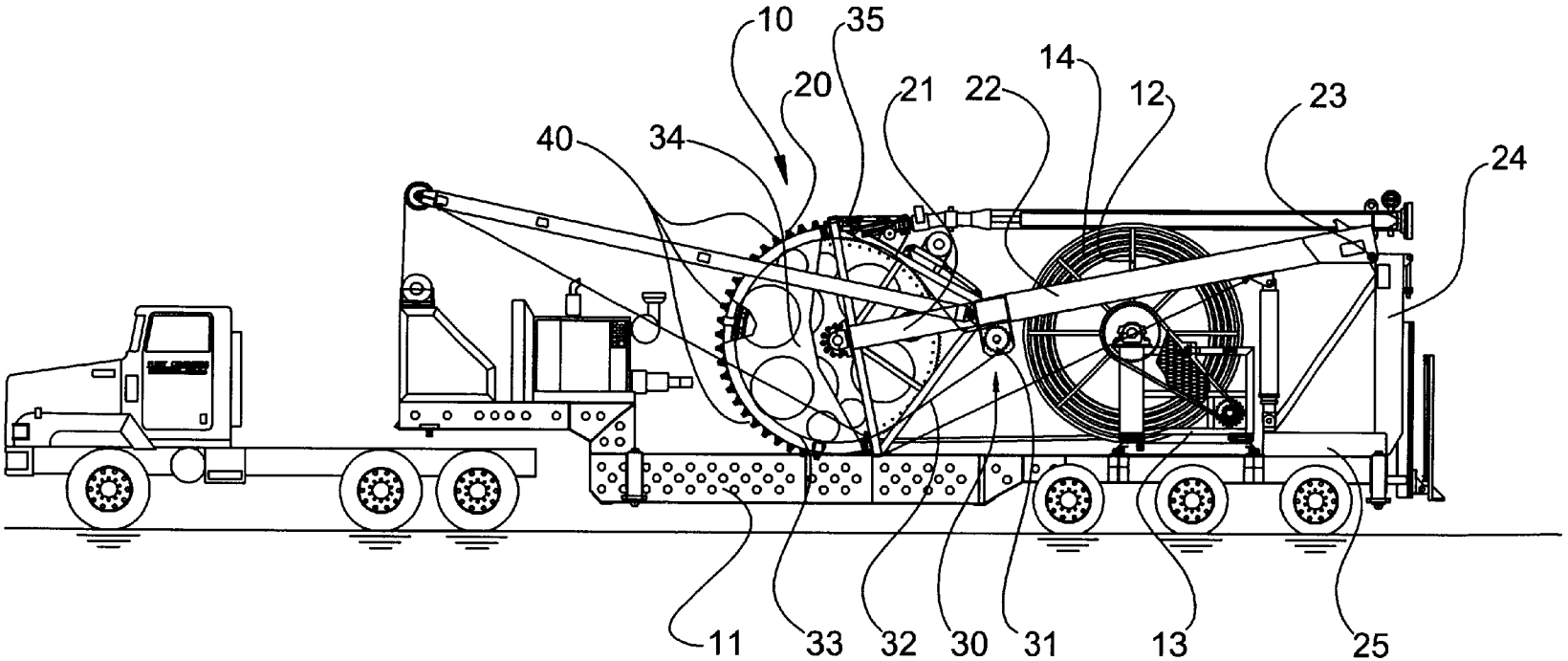
FIG. 1 is a side elevation view of the coiled tubing aspect of the apparatus, illustrated in a road transport mode, and constructed according to an embodiment of the present invention.

Having reference to FIG. 1, a coiled tubing injector is mounted on a mobile deck 11 such as a truck or trailer or on a separate frame (not shown) which could be slid or lifted onto or off of a truck or trailer.

As disclosed in U.S. Pat. No. 5,839,514 to Gipson, a coiled tubing storage reel or spool 12 is mounted on a cradle 13, and coiled tubing 14 is stored thereon. The cradle 13 is attached to a traversing mechanism which allows the cradle to be reciprocated perpendicularly to the axis of the deck 11.

An injector reel 20 is rotatably attached to the distal end 21 of boom arm or mast 22. Mast 22 is attached at hinge member 23 to mast riser 24. Mast riser 24 is attached to the back end 25 of deck 11.

Figure 2:
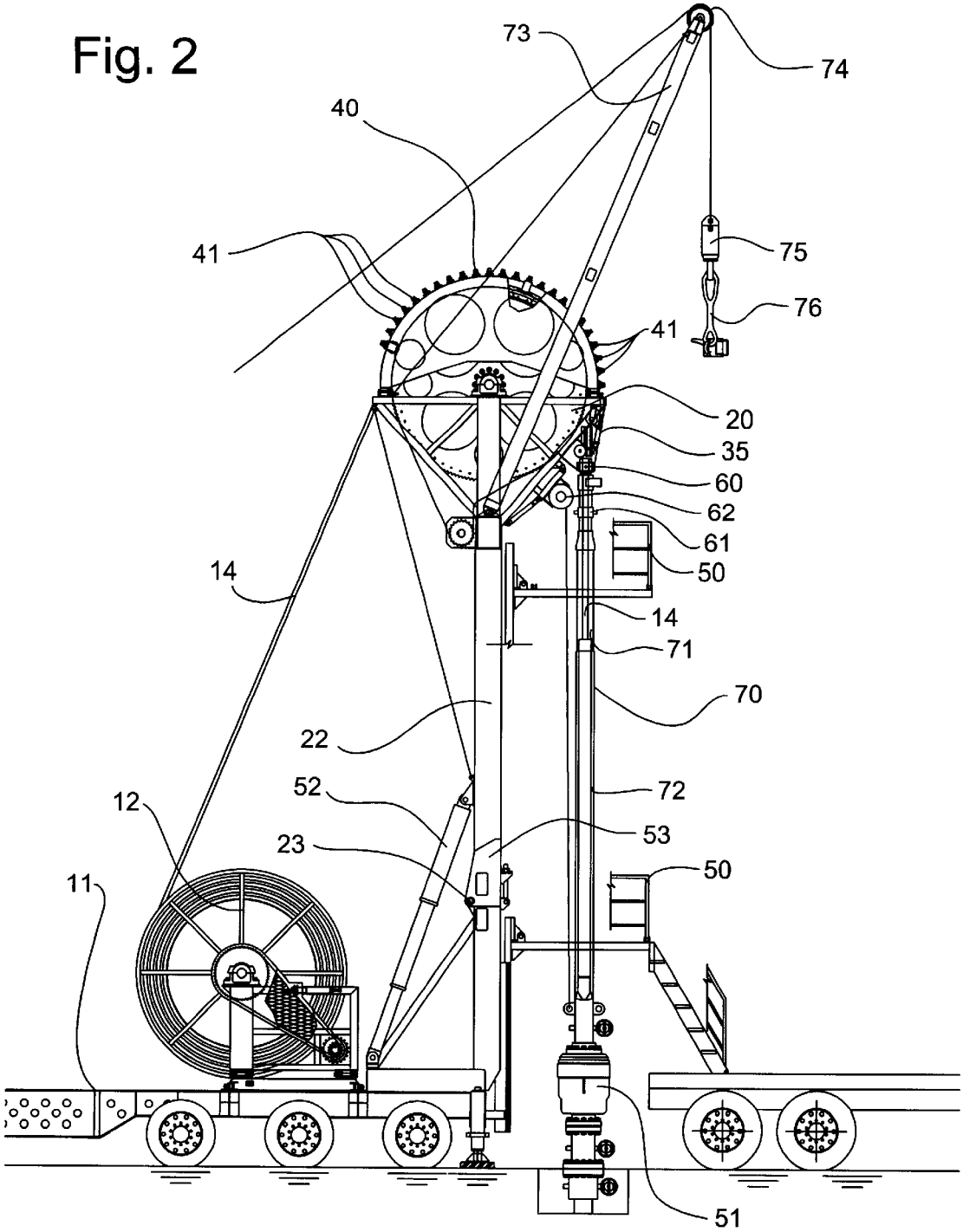
FIG. 2 is an overall side elevation view of the apparatus according to FIG. 1, arranged over a well bore in an injecting/drilling position.
Figure 3:
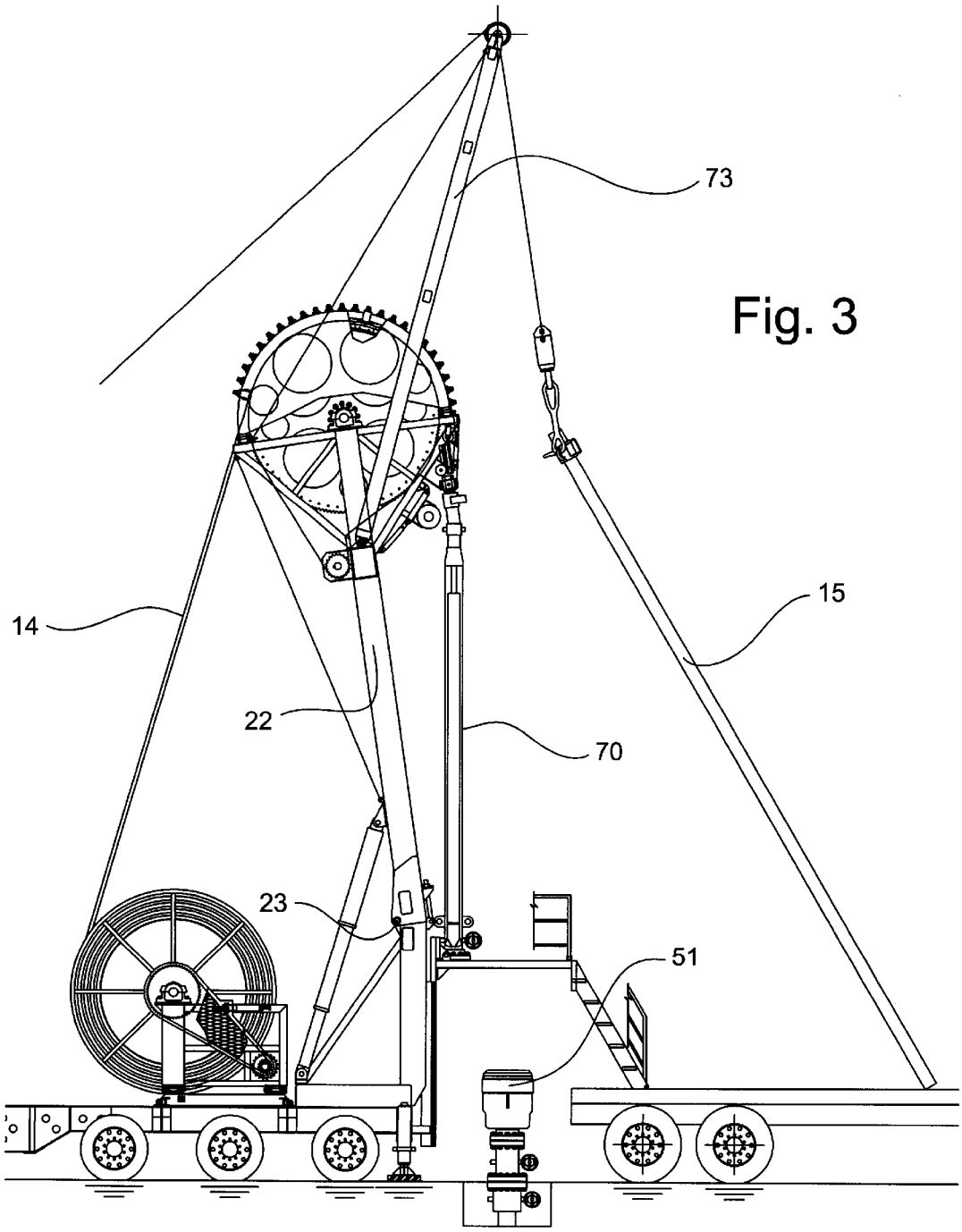
FIG. 3 is a side elevation view of the apparatus according to FIG. 2, wherein the mast is tilted out of alignment from the wellhead for handing lengths of tubing and BHA.

Having reference to FIG. 2, the injector reel 20 is further provided with a drive mechanism 30 which includes a hydraulic drive motor 31, a drive chain linkage 32, and sprocket assembly 33 extending circumferentially around the injector reel 20.

Reel support frame 34 also extends circumferentially around reel 20 and supports a straightener assembly 35 and a hold down assembly 40.

Hold-down assembly 40 consists of a multiplicity of separate hold down mechanism 41. Twenty hold-down mechanisms 41 are mounted around a portion of the circumference of the injector reel 20 to exert pressure against the coiled tubing 14 over more than 90 degree of the circumference of the injector reel 20.

The straightener 35 applies unequal pressure against the coiled tubing 14, plastically altering the curve of the tubing so that it leaves the straightener 35 as linear tubing, without any residual curve.

A hydraulically activated elevating work floor 50 is movable along the working length of the mast 22 and particularly adjusts for variable classes of Blow-out Preventor (BOP) 51 which, when fitted to the well and wellhead can vary up to 2 meters in final installed height.

As shown in FIG. 2, in a first position, the mast 22 is raised by a mast lift cylinder 52, pivoting about hinge 23, to a tubing injection position generally perpendicular to the deck 11. Swing locks 53 (one on each side of mast 22) are latched to secure the mast 22 and injector reel 20 in the uplift position. In the first injecting position, coiled tubing 14 extends from the storage spool 12 up and over the injector reel 20. The hold-down assembly 40 extends around a portion of the circumference of the injector reel 20 to exert pressure on the coiled tubing 14 as it is straightened and injected into the well or returned to the spool 12.

When the embodiment is in the injecting position, tubing 14 exits the injector reel 20 generally perpendicular to the ground. In cases where the drilling has progressed past the surface casing stage, when tubing 14 exits the injector reel 20 it is generally aligned with the BOP 51.

A telescoping tubing stabilizer 70 has an upper section 71 and a lower section 72. The stabilizer 70 extends between the straightener assembly 35 and the BOP 51 at the wellhead. The function of the stabilizer 70 is to ensure that the coiled tubing 22 does not bend or excessively flex as it is being injected.

A swivel bushing 60 supports the upper section 71 of the telescoping tubular stabilizer 70 where it connects to the straightener assembly 35. A misaligning union 61 between the stabilizer's upper section 71 and the straightener 35 allows for misalignment of the stabilizer with respect to the BOP 51 with no adverse effects. A hydraulic winch 62 mounted on the mast 22 is used to collapse and extend the stabilizer 70.

The mast 22 is fitted with a jib crane 73 and hoist 74. The hoist 74 has a travelling block 75. Bales and an elevator 76 are hung from the block 75 for lifting lengths of casing, tubing and the like.

Rather than use a separate crane to lift and lower long lengths of sectional tubing (e.g. 30 feet long) at the well, the jib crane 73 extension is provided from the mast 22. Further, to enable alignment of sectional tubing 15 over the BOP 51, the coiled tubing rig injector 20 must be moved out of its working alignment from the BOP 51. Accordingly, the mast 22 is pivotable adjacent the BOP 51 so as to tilt it out of the way and permit the jib crane 73 access to the BOP.

Once a Bottom Hole Assembly (BHA) or other sectional tubular components 15 are placed at or through the BOP, there must be means capable of making up the threaded joints.

Figure 4:
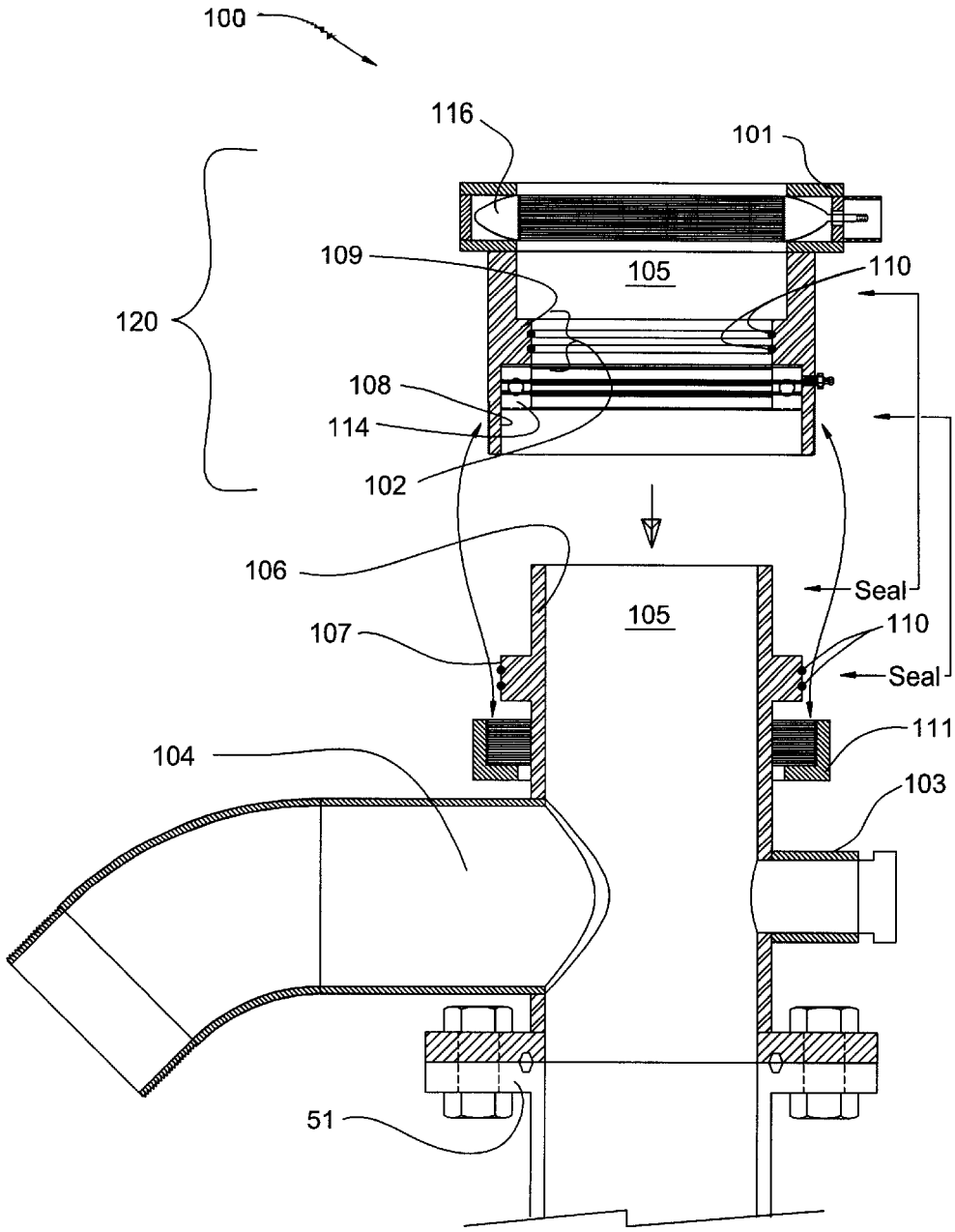
FIG. 4 is a partial side and exploded view of the rotary table with a flow tee incorporated therein. The bottom housing is flanged to the BOP and the top housing is shown separated from the bottom housing.

Having reference to FIGS. 4–7*b*, mounted atop the BOP 51 is a rotary table 100 which comprises top and bottom housings 101,103, spaced apart by a ring bearing 102. As shown in FIG. 4, the bottom housing 103 is incorporated into a flow tee 104. Generally, the flow tee 104 is positioned directly above the BOP 51. The top and bottom housings 101,103 have a bore 105 which is complementary to the BOP 51 and wellhead, suitable for passing the coiled tubing 14 and also jointed sections such as the BHA.

The bottom housing 103 comprises an upstanding sleeve 106 having an intermediately located and radially outward projecting annular bottom shoulder 107. The top housing 101 has a downward extending sleeve 108 and an intermediately located inwardly projecting annular top shoulder 109. The upstanding sleeve 106 of the bottom housing 103 fits closely through the top shoulder 109. The downward sleeve 108 of the top housing 101 fits closely over the bottom shoulder 107. O-Ring seals 110 at the nose of each of the top and bottom shoulders 109,107 seal against the bottom and top housings sleeves 106,108 respectively.

The ring bearing 102 is sandwiched between the top and bottom annular shoulders 109,107, permitting the top housing 101 to rotate freely on the bottom housing 103.

The top housing 101 is retained to the bottom housing 103 using a threaded collar 111 located below the bottom shoulder 107. The collar 111 is threaded onto the top housing's sleeve 108, pulling the top housing 101 onto the bottom housing 103, loading the ring bearing 102 therebetween.

Best shown in FIG. 6*a*, the ring bearing 102 is sectional comprising a top race 112, a bottom race 114 and an intermediate cage ring 113 fitted with a multiplicity of ball bearings 115. In FIG. 4, one can see that, when assembled, the bottom race 114 is seen to be supported by and rests on the bottom shoulder 107. The cage ring 113 rests on the bottom race 114 and the top race 112 bears against the cage ring 113.

Figure 5:
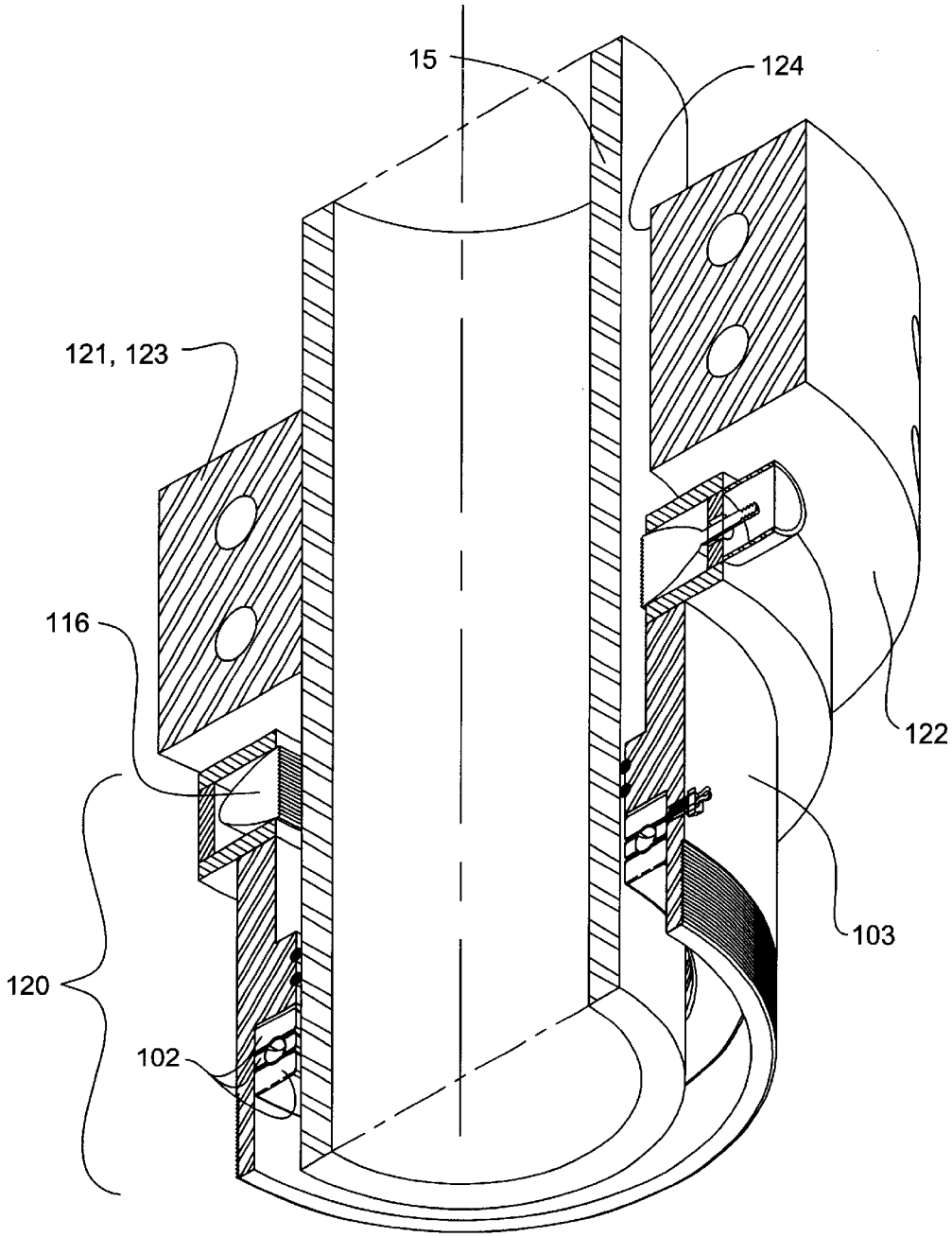
FIG. 5 is an upward perspective sectional view of jointed sectional tubing passing through the rotary table's top housing. The tubing is fitted with a split clamp, both of which are ready to set down on the top housing for rotary capability.

In FIG. 5, the top housing 101 seen to provide a general service rotary section 120 supported on the ring bearing 102 rotation about the vertical axis 20 of the BOP 51.

The rotary section 120 further incorporates means 121 for controllably and periodically gripping the jointed sections 15 while operations are performed. Gripping means 121 are installed to grip the jointed section 15 and form a bottom surface 122 for transmitting the weight of the gripped jointed sections through the top housing 101 and into the annular bearing 102. Thus, the jointed sections 15 are prevented from being lost down the well yet, are easily rotated on the annular bearing 102 for making up successive threaded joints of tubing 15.

The gripping means 121 are typically a slip arrangement or a split clamp. After the gripping means 121 are secured about the jointed section 15, it bottom surface 122 is lowered into engagement with the top housing 101 or rotary section 120 and the top housing bears against the top race and transmits the weight of the jointed section 15 into the BOP 51 while permitting it to rotate. Typically, it is inconvenient to access the end of the jointed section 15 to apply the gripping means 121. Accordingly, the gripping means 121 can be applied to support at the mid-point of a length of tubing.

One conventional form of gripping means (not shown) include a plurality slip type gripping units (not shown). Circularly spaced wedge slips have outer tapering surfaces which engage correspondingly tapered surfaces of the rotary section to cam the slips inwardly in response to downward movement thereof. The inner gripping faces of the slips are formed with teeth or other irregularities adapted to engage the outer surface of the jointed section to transmit tubing weight into the rotary section and support it in the well.

Another form of rotary section gripping means 121 is a split clamp (FIG. 5) having a cylindrical body split diametrically into two body halves 123. Two body halves 123 have facing semicircular recesses or gripping surfaces 124 and are positioning on either side of the tubing 15 to be supported. The two body halves 123 are sized so that when clamped about tubing 15, they do not bottom against each other, the diametral depth of their combined recesses 124 being less than the diameter of the jointed section 15.

When clamped about the tubing 15, the two body halves 124 combine to become the cylindrical body of the split clamp gripping means 121 which then rests upon the top housing 101.

A BHA can now be made up by supporting each jointed section 15 through the BOP 51, supported by the split clamp body halves 123,123 and top housing 101 and be rotated while using chain tongs to tighten joints. Further, the completed and heavy BHA can be rotated freely and supported on rotary section 120 so as to thread it onto the connection to the non-rotating coiled tubing 14. As shown in FIGS. 5 and 6*c*, once the tubing 15 is through the top housing, an inflatable packer 116 is inflated to seal the tubing 15 therein.

By implementing the rotary table 100 as described, it has been found that usual BHA make up time of about 6 hours can now be accomplished in about 0.5–1.0 hours.

Further once spudded in and surface casing is placed, the preferred coiled tubing rig can drill 1100 meters of hole and have production casing placed, including cement, in about 16 hours, faster than that of a conventional jointed tubing rig by about 24–30 hours. The surface hole can be drilled using sectional tubing 15 or using the coiled tubing 14. Surface casing run in with the jib 73 and elevators 76.

The preferred injector 20 is capable of up to 15,000 lb. force and it with PDC bits (polycrystalline diamond compact, typically needing only about 9,000 lbf) may not even be necessary to use additional drill collars for weight. Drill collars may yet be added for stabilization to aid in keeping the surface hole straight.

The embodiments of the invention for which an exclusive property of privileges is claimed are defined as follows:

1. Hybrid apparatus for operation with both coiled and sectional tubing apparatus comprising:

a coiled tubing rig having a frame and a mast normally aligned over a wellhead, an injector located on the mast and a tubing straightener positioned between the injector and the wellhead;

a rotary table affixed to the well head for rotationally supporting sectional tubular components passing through the wellhead;

a jib crane mounted atop the mast; and means for pivoting the mast between two positions, (i) a first position where the mast, injector and straightener are aligned with the wellhead for injection and withdrawing of coiled tubing, and (ii) a second position with the mast pivoted out of alignment from the wellhead so that the jib crane can align sectional tubing with the wellhead and be supported therefrom and be made up on the rotary table.

2. The hybrid apparatus of claim 1 wherein the sectional tubing is a BHA.

3. The hybrid apparatus of claim 1 further comprising power tongs for enabling sectional production casing to be quickly made up and run in through the wellhead.

4. A method of drilling a well using coiled tubing comprising the steps of:

providing a rotary table over the well;

providing a mast supporting a coiled tubing injector, said mast being normally aligned over the wellhead;

pivoting said mast out of alignment with the wellhead;

standing tubular sections on the rotary table to enable rotation of adjacent sections for making up a drilling assembly including a downhole motor and drill bit, using a crane supported on said mast, said drilling assembly being supported in the well using the rotary table;

re-aligning the coiled tubing injector over the made up drilling assembly for injecting coiled tubing through the wellhead for connection to the drilling assembly;

rotating the rotary table for rotating the drilling assembly supported on the rotary table to make up to the coiled tubing; and drilling the well through the rotary table.

5. The method of claim 4 further comprising:

(a) spudding a well with a conventional drilling rig and installing a wellhead; and (b) fitting the rotary table to the wellhead.

6. The method of claim 5 wherein the drilling assembly comprises a BHA.

7. The method of claim 6 further comprising;

(a) positioning a coiled tubing rig over the well, the rig having a mast with a jib crane, an injector being mounted in the mast's top with a straightener mounted between the injector and the well;

(b) moving the injector and straightener out of alignment for lifting tubular sections and standing them on the rotary table for making up the drilling assembly; and (c) moving the injector and straightener into alignment with the rotary table for making up the drilling assembly to the coiled tubing.

8. Hybrid apparatus for operation with both coiled and sectional tubing apparatus comprising:

a coiled tubing rig having a frame and a mast normally aligned over a wellhead, an injector located on the mast and a tubing straightener positioned between the injector and the wellhead;

a rotary table affixed over the well head for rotationally supporting sectional tubular components passing through the wellhead;

a jib crane mounted atop the mast; and means for pivoting the mast between two positions, (i) a first position where the mast, injector and straightener are aligned with the wellhead for injection and withdrawing of coiled tubing, and (ii) a second position with the mast pivoted out of alignment from the wellhead so that the jib crane can align sectional tubing with the wellhead and be supported therefrom and be made up on the rotary table.

9. The hybrid apparatus of claim 8 wherein the sectional tubing is a BHA.

10. The hybrid apparatus of claim 9 further comprising power tongs for enabling sectional production casing to be quickly made up and run in through the wellhead.

* * * * *